US008356555B2

(12) United States Patent
Schmitz et al.

(10) Patent No.: US 8,356,555 B2
(45) Date of Patent: Jan. 22, 2013

(54) PROJECTILE MADE OF STEEL SOFTENED TO THE CORE

(75) Inventors: Alain Schmitz, Harze (BE); Gisele Walmag, Tilff (BE); Vittorino Tusset, Oupeye (BE)

(73) Assignee: Centre de Recherches Metallurgiques asbl—Centrum voor de Research in de Metallurgie vzw, Brussels (BE)

( * ) Notice: Subject to any disclaimer, the term of this patent is extended or adjusted under 35 U.S.C. 154(b) by 671 days.

(21) Appl. No.: 12/302,968

(22) PCT Filed: May 21, 2007

(86) PCT No.: PCT/BE2007/000048

§ 371 (c)(1),
(2), (4) Date: Dec. 1, 2008

(87) PCT Pub. No.: WO2007/143800

PCT Pub. Date: Dec. 21, 2007

(65) Prior Publication Data

US 2009/0301338 A1 Dec. 10, 2009

(30) Foreign Application Priority Data

Jun. 16, 2006 (BE) ..... 2006/0329

(51) Int. Cl.

| | |
|---|---|
| ***B21H 1/14*** | (2006.01) |
| ***F42B 12/74*** | (2006.01) |
| ***F42B 7/04*** | (2006.01) |
| ***F42B 12/80*** | (2006.01) |

(52) U.S. Cl. ..... 102/501; 102/448; 102/459; 86/57; 29/899

(58) Field of Classification Search ..... 102/448, 102/459, 517, 501; 86/57, 54; 29/899
See application file for complete search history.

(56) References Cited

U.S. PATENT DOCUMENTS

| | | | | |
|---|---|---|---|---|
| 2,867,554 | A | 1/1959 | Wilson et al. | |
| 4,023,985 | A | 5/1977 | Dunkerley et al. | |
| 4,035,116 | A | 7/1977 | O'Brien et al. | |
| 6,258,316 | B1 | 7/2001 | Buenemann, Jr. et al. | |
| 6,394,881 | B1 | 5/2002 | Watanabe et al. | |
| 6,749,662 | B2 | 6/2004 | Bueneman et al. | |
| 7,399,334 | B1 * | 7/2008 | Wei et al. | 75/246 |

FOREIGN PATENT DOCUMENTS

| | | | |
|---|---|---|---|
| JP | 2163301 | A | 6/1990 |
| WO | WO 00/44517 | A1 | 8/2000 |

* cited by examiner

*Primary Examiner* — James Bergin
(74) *Attorney, Agent, or Firm* — Reinhart Boerner Van Deuren P.C.

(57) ABSTRACT

The present invention relates to a process for manufacturing a projectile made of steel or based on iron, for a hunting or sports cartridge, for the purpose of giving it a Vickers hardness at room temperature of between 40 HV 10 and 110 HV 10, preferably between 40 HV 10 and 85 HV 10, characterized at least by the following successive steps:—liquid pig iron or steel is used, hereafter called liquid metal, the carbon content of which is between 0.8 and 4.0% C by weight, preferably between 0.8 and 2.0% C by weight;—the liquid metal is cast using a steam or water-vapor granulation process to obtain spheroidal steel particles; —said particles are subjected to a heat treatment for softening the solidified metal by graphitization, while remaining in the ferritic range; and—optionally, said particles are subjected to a surface coating treatment.

21 Claims, 2 Drawing Sheets

T = 1150°C

Annealed 180s

HV5 = 613

T = 700°C

Annealed 24h

T = 1150°C

Annealed 180s

HV5 = 613

T = 650°C Annealed 24h

HV5 = 95

HV5 = 205

PROJECTILE MADE OF STEEL SOFTENED TO THE CORE

CROSS-REFERENCE TO RELATED PATENT APPLICATIONS

This patent application is the National Stage of International Application No. PCT/BE2007/000048, filed May 21, 2007, that claims the benefit of Belgium Application No. 2006/0329, filed Jun. 16, 2006, the entire teachings and disclosure of which are incorporated herein by reference thereto.

FIELD OF THE INVENTION

The present invention relates to a method for manufacturing steel projectiles such as balls for hunting cartridges as a substitute for traditional lead shot.

The invention also relates to steel projectiles and cartridges obtained by the method.

TECHNOLOGICAL BACKGROUND

The global market for hunting lead shot is currently 120,000 tonnes per annum. In Europe, it is about 60,000 tonnes.

As a result of stricter environmental regulations, the use of lead in ammunition for hunting and target shooting is already banned in several European countries (especially in the Netherlands, Sweden and Germany), in particular for shooting in wetlands.

Among the possible and economically viable technical solutions for substitutes for hunting lead shot (iron, steel, heavy metals, alloys, ceramics, etc.), only steel shot appears to be a viable alternative. Indeed, it has satisfactory density, is non-toxic, comes to an affordable price, etc.

For about twenty years, steel shot has also been marketed in North America as a substitute charging by the biggest manufacturers in the sector.

It is known that the charging of a cartridge comprises spherical balls that not only have a diameter tolerance of about 0.1 mm but also a narrow weight tolerance in order to guarantee reproducible ballistic behaviour and to ensure constant charging of the cartridge, which is done by volumetric measurement. The steel balls must be subjected to a surface treatment such as copper plating, addition of graphite, etc. in order to prevent any aggregation of the charging, which could adversely affect good dispersion.

The calibres of the most frequently used charges are shown in Table 1 below.

For this type of application, a low-alloy soft-steel type of composition such as for example: max. 0.06% C, max. 0.4% Mn, max. 0.1-0.3% Si, max. 0.04% P, max. 0.04% S, is sought.

The hardness must be as low as possible, not exceeding 110 HV 10 at the surface and 100 HV 10 at the core.

Currently, from the purely ballistic point of view, hunters and marksmen have a clear preference for the lead shot that is traditionally used. Indeed, they consider that lead shot has some specific ballistic features that are difficult to find in substitute products.

The traditional market of hunters and marksmen thus demonstrate some reluctance to use the steel ball cartridges currently on the market. The main arguments to justify this reluctance towards steel balls are associated with the following aspects:

- increased risk of ricochets,
- greater wear of the barrel,
- greater loss of speed and penetration as a function of distance,
- higher ammunition price.

Other non-toxic alloys (for example "Hevi-Shot": tungsten-nickel-iron) have also been developed. They can technically compete with steel shot since, due to their high density, they provide a ballistic behaviour that is similar to that of traditional lead charging. However, these alloys are too expensive.

On the other hand, with regard to the production of steel shot, there are two possible methods.

From Molten Steel

Given the tonnages to be produced, this process entails setting up the method on premises for manufacturing molten steel with the capacity of a foundry type and supplementing it with a suitable granulation unit. Various techniques for the granulation of molten metal are available on the market:

- the Osprey method, gaseous atomisation under pressure, does not really fall within the "granulation" type since it is dedicated to the production of fine particles (100 μm) intended for powder metallurgy;
- water granulation: a jet of steel is cast under a high-pressure water jet or directly into a trough. The size of the particles obtained may vary (from one to several millimeters depending on the technique) but the common feature of these is the irregular, non-spherical shape of the product;
- steam granulation: this method, developed in particular by Mintek (South Africa), uses a jet of steam, which allows to avoid an excessively violent mechanical disturbance of the metal stream.

This type of method entails a wide size distribution as a result of the absence of spherical shape, which leads to the loss of part of the production (yield of the order of 60%). Moreover, in contrast to lead, which has a much lower melting point than steel, it is difficult to re-melt the steel balls produced outside the calibre in a closed circuit.

The best results are obtained with a steel with a very high carbon content (>1.5%) whose hardness is lower than 100 HV 10 or even 80 HV 10. ULC steels are not to be used in the frame of this technique.

To reduce the size distribution, some methods precede the water granulation with a system for dividing the flow of molten metal. The latter is for example spread over a rotating plate before it is subjected to final water or steam granulation.

From Wire or Sheet (Mechanical Method)

This method is inspired by the techniques for manufacturing nails or other high-volume pieces of steel. Striking and stamping operations on drawn wire or on sheet allow to obtain balls. Machines are known that allow to manufacture steel ball for bearings. From a reel of steel wire, a steel blank is cut for subsequent and progressive transformation into balls by deformation between grooved, generally cast, plates.

The wire used is of a ULC type, for example with a carbon content of 0.02% C. This type of wire is very expensive and not at all readily available if one bears in mind the quantities to be produced in the sector of hunting cartridges. On the other hand, the advantage of wire is that the yield from production is 100%.

With flat steels, soft steels are much more readily available, including in various thicknesses thus corresponding to various ball diameters. Unfortunately, given the waste, part of the production is also unusable in this case.

From Iron Powder

Powder metallurgy is used to manufacture some pieces, usually of a complex form, from metal materials. This consists in compacting the powder in a mould and subjecting the whole to a high-temperature sintering operation.

Some tungsten carbide spheres are in particular prepared by this technique. Starting with iron powder, one may envisage to examine the possibility of obtaining extra-soft steel balls by a compaction/sintering method.

To summarise, the techniques for obtaining balls from wire, sheet and iron powder have the disadvantage of being more expensive than the molten technique.

State of the Art

In the state of the art, a current economical method is known for softening by decarburisation a carbon steel such as a large-crystal ferrite. Let us recall that a single-crystal pure iron has extremely low hardness (30-40 HV 10), which may be considered as the absolute lower limit.

Document WO-A-00/44517 proposes a steel projectile and associated manufacturing method with relatively high carbon content (up to 1.5% C), produced by water atomisation and softened by annealing under non-oxidising atmosphere at controlled dew point, at a temperature between 600 and 1,200° C., in order to make it suitable for ballistic use. The softening mainly results from surface decarburisation, preferably with an average Knoop surface hardness lower than 225 (Vickers surface hardness at least higher than 130).

Aims of the Invention

The present invention aims to provide a solution that does not have the drawbacks of the state of the art.

In particular, the invention aims to provide a treatment based on a common grade of steel allowing to obtain a final hardness lower than 100 HV 10.

In addition, one aim of the invention is to provide this treatment with a view to obtaining low hardness in steel balls, uniformly across their entire volume (at the core).

An additional aim of the invention is to eliminate a certain tendency to ricochet, which is commonly inherent to steel projectiles.

A further aim of the invention is to allow the manufacture of balls with a good spherical shape.

Yet another additional aim of the invention is to manufacture steel balls with (self)-lubricating properties that allow reduced wear of the barrel of the weapon.

Main Characteristic Elements of the Invention

A first aim of the present invention relates to a method for manufacturing a projectile made of steel or based on iron for cartridges for hunting or target shooting with a view to give it a hardness between 40 HV 10 and 110 HV 10 at room temperature, preferably between 40 HV 10 and 85 HV 10, characterised by at least the following successive steps:

- liquid steel or pig iron, hereafter called molten metal, whose carbon content is between 0.8 and 4.0% C by weight, preferably between 0.8 and 2.0% C by weight, is used;
- the molten metal is cast according to a water or steam granulation method in order to obtain spheroid steel particles;
- said particles are subjected to a heat treatment for softening the solidified metal by graphitisation while remaining in the ferritic range;
- said particles are possibly subjected to a surface coating treatment.

According to the invention, the softening heat treatment comprises at least the following successive steps:

- said metal is annealed for about 3 minutes from room temperature up to a temperature higher than 800° C.;
- said steel is cooled in water, preferably in boiling water, at a speed of at least 20° C./s down to room temperature;
- said metal is tempered under non-oxidising or slightly reducing atmosphere of HNx type to a temperature below 700° C., preferably below 650° C.;
- said metal is maintained under the above-mentioned atmosphere at this last temperature for a period of between 1 and 6 days, preferably between 1 and 4 days.

Maintaining the method of the invention under non-reducing atmosphere is mandatory to prevent the decarburisation of the prior art methods.

As an advantage, the metal also comprises, expressed in weight, a maximum of 0.4% Mn, between 0.1 and a maximum of 2.0% Si, a maximum of 2.0% Al, a maximum of 0.04% P, a maximum of 0.04% S and a maximum of 1% of other alloy elements, the balance being iron and common impurities. Silicon or aluminium in suitable quantities confers an additional inoculating effect to the extent that they both increase the precipitation strength of graphite, thereby reducing the graphitisation time without the presence of residual cementite.

According to a preferred embodiment of the invention, the water or steam granulation step is carried out in the presence of a surfactant.

As an advantage, the water or steam granulation step is preceded by the step of dividing the flow of the molten metal.

The step of dividing the flow of molten metal is preferably carried out by means of a rotating plate.

According to a first embodiment, the rotating plate is a plate made of a material that is not wetted by the molten steel such as zirconia, alumina, boron nitride or syalon.

According to a second embodiment, the rotating plate is a perforated plate.

According to another preferred embodiment, the water or steam granulation step is replaced by a sintering step using iron powder.

According to a third preferred embodiment, the water or steam granulation step is replaced by a step of mechanical manufacturing using wire or sheet.

A second aim of the present invention relates to a steel spheroid projectile or ball with a carbon content between 0.8 and 2.0% C by weight and with a core hardness lower than 100 HV 10, preferably lower than 85 HV 10, implemented by means of the above-mentioned method.

As an advantage, said projectile has a carbon content between 1.2 and 1.8% C by weight.

The projectile is preferably provided with a surface coating to prevent aggregation of the charging.

A third aim of the present invention relates to a cartridge for hunting or target shooting comprising a charging of steel balls such as those described above.

SHORT DESCRIPTION OF THE DRAWINGS

DESCRIPTION OF AN EMBODIMENT OF THE STATE OF THE ART

Figure 1:
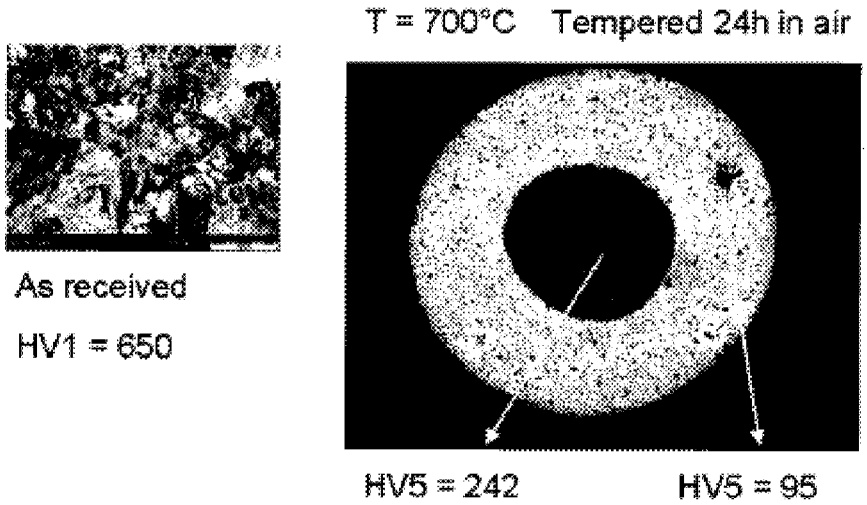
FIG. 1 represents micrographic sections of steel balls respectively before and after the decarburisation treatment of the steel according to the state of the art.

As indicated above, the state of the art consists in softening by annealing under decarburising atmosphere, a common steel such as a hypereutectoid steel (for example 1.5% C by weight) made of carbon-supersaturated ferrite (cementite Fe3C). The example of FIG. 1 relates to the decarburisation treatment of steel balls obtained by water-atomisation from an initial steel of this type with a Vickers hardness of HV=650. After tempering for 24 hours in air at 700° C., a greatly softened surface layer (HV=95) and a martensite with an appreciably softened core (HV=242) relative to the initial hardness are obtained. The mechanism is the decarburisation of the outer layer of the ball due to diffusion of carbon at the surface of the ball where it combines with oxygen to form carbon dioxide which escapes into the atmosphere.

Remark: The hardness values are expressed in Vickers hardness, the measurement method being well known to the man skilled in the art (see e.g. standard EN ISO 6507-1).

Description of a Preferred Embodiment of the Invention

The original treatment of the invention allows to obtain totally unexpected properties for a steel and in particular for a steel with high carbon content.

Contrary to expectations, the Applicant has shown in the context of the present invention that, based on a steel with high carbon content, which is easily produced by means of the electric-furnace method for example, a specific treatment allowed to obtain a final steel with very low hardness (for example 85 HV 10) and mechanical characteristics that minimise the ricochet effect in the field of ballistics.

This specific treatment, preferably combined with a method for manufacturing spherical shot from liquid steel and possibly with a surface-coating treatment that prevents the aggregation of the steel balls in the cartridge, allows to manufacture a new product based on recarburised liquid steel.

As a further preference, granulation is carried out with steam with the addition of a specific surfactant.

Figure 2:
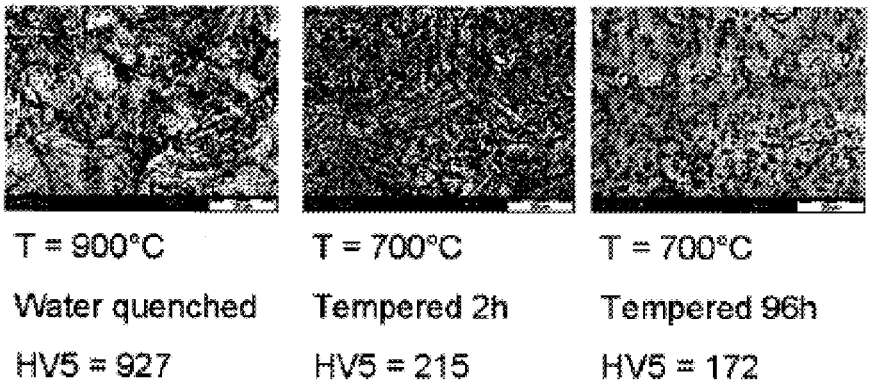
FIG. 2 represents micrographic sections respectively before and after the thermo-chemical treatment similar to that of the invention in the case of a eutectoid steel.

In a first trial phase, a perlitic steel of eutectoid composition (0.8% C by weight) was annealed so as to be brought in the austenitic range. Hence, the temperature of the steel is brought to 900° C., which gives a hardness of HV=927. The temperature is then lowered from 900° C. to room temperature (T=20° C.) by quenching in water so as to obtain martensite (a carbon-supersaturated solid solution). Then, the steel is tempered to a point that is not beyond the ferritic range (T<727° C.), for example 700° C. After keeping it in air for 2 hours, or 96 hours respectively, a reduced Vickers hardness of 215 or 172 respectively is obtained (see FIG. 2). In the latter case, a ferrite is observed in the end with finely distributed inclusions of small spherical carbide particles, which corresponds to the coalescence phenomenon (right section, FIG. 2).

Figure 3:
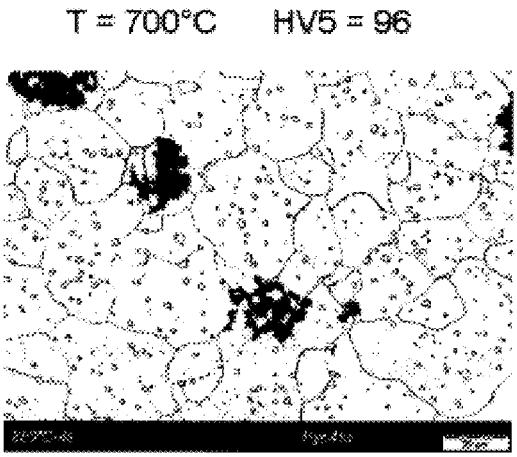
FIG. 3 represents micrographic sections respectively before and after the thermo-chemical treatment similar to that of the invention in the case of a hypereutectoid hot-rolled steel (1.2% C by weight).

In the state of the art, a similar treatment of a hot-rolled product in the case of a hypereutectoid steel (1.2% C by weight) is known. In the micrograph shown in FIG. 3 corresponding to a hardness of HV=96, carbides and small flakes or nodules of pure graphite are nevertheless observed here. A hypereutectoid composition of the steel leads to a globular iron-graphite balance. These graphite nodules significantly soften the steel compared with the previous example.

In the present invention, and in contrast to the state of the art, increasing the initial proportion of carbon in the steel will therefore be favoured in order to increase graphite precipitation and hence the softening of the microstructure during the recommended treatment.

Figure 4:
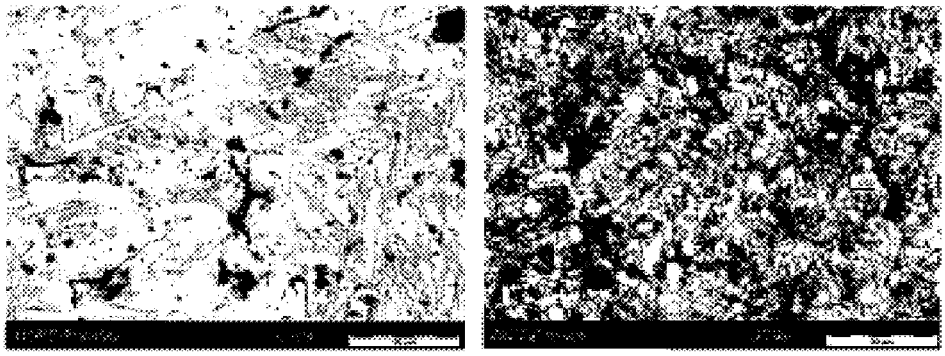
FIG. 4 represents micrographic sections respectively before and after the thermo-chemical treatment where the tempering temperature is 700° C., in the case of a hypereutectoid steel (1.5% C by weight).

In another trial, steel balls manufactured as in the state of the art (liquid method) and of hypereutectoid composition (1.5% C by weight) were annealed for 180 seconds up to a temperature of 1,150° C. (HV=613), cooled in water to room temperature and then tempered to 700° C., this temperature being maintained for 24 hours. The microstructure obtained here does not allow to achieve the desired aim since it leads to the formation of a perlite-type structure (aggregate of ferrite and precipitated cementite) with a hardness of the order of 240 (FIG. 4). The absence of graphitisation is no doubt due to the fact that, in this case, the annealing temperature is higher than that of the eutectoid (steel brought by excess in the austenitic range).

Figure 5:
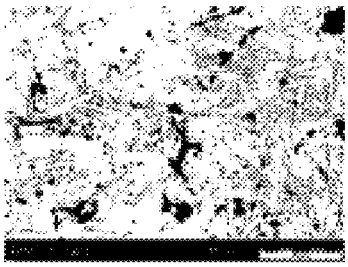
FIG. 5 represents micrographic sections respectively before and after the thermo-chemical treatment as in the invention in the case of a hypereutectoid steel (1.5% C by weight), the tempering temperature being 650° C.
Figure 5:
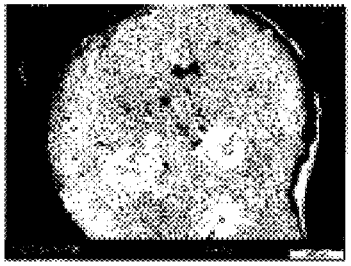
Figure 5:
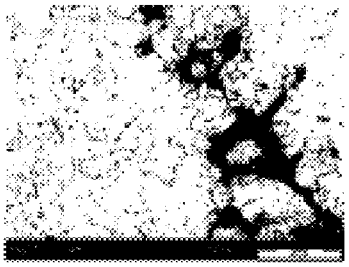
Figure 5:
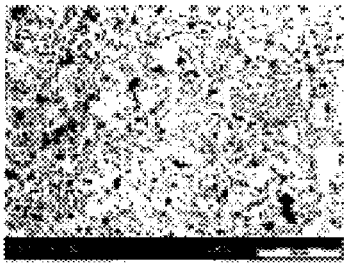

In yet another trial, steel balls manufactured as in the state of the art (liquid method) and of hypereutectoid composition (1.5% C by weight) are annealed for 180 seconds up to 1,150° C. (HV=613). The steel is then quenched in water to room temperature, tempered to 650° C., and maintained at this temperature for 24 hours. This treatment allows to obtain a heterogeneous hardness with dark zones of hardness HV=205 which correspond to a ferrite matrix with precipitation of carbides that start to graphitise (right curve, FIG. 5) and other "white" or light zones of hardness HV=95 that produce little strings of graphite (left curve, FIG. 5).

The invention has the following advantages:

- achieving a microstructure with a soft graphite phase serving as an energy absorber, which is of interest in particular for eliminating ricochets;
- lubricating effect of the graphite which causes reduced wear on the barrel of the weapon and avoids using a particular polymer wad as in the state of the art;
- using a common steel with high carbon content that avoids the difficulties of castability;
- good spherical shape of the balls obtained from carbon-loaded steels;
- treatment of the ball through its entire volume (to the core) as in the invention with a low and even hardness whereas the route of decarburisation as in the state of the art produces heterogeneous hardness, namely low at the surface and higher in the core.

TABLE 1

| No. | 9 | 8½ | 8 | 7½ | 7 | 6 | 5 | 4 | 3 | 2 | 1 | B | BB | BBB | T |
|---|---|---|---|---|---|---|---|---|---|---|---|---|---|---|---|
| ϕ (mm) | 2.03 | 2.16 | 2.29 | 2.41 | 2.54 | 2.79 | 3.05 | 3.3 | 3.56 | 3.81 | 4.06 | 4.32 | 4.57 | 4.83 | 5.08 |

The invention claimed is:

1. A method comprising:

manufacturing a steel or iron-based projectile for cartridges for hunting or target shooting in order to give it a hardness between 40 HV 10 and 110 HV 10 at room temperature, the hardness being substantially even throughout the volume of the steel or iron-based projectile, characterised by at least the following successive steps:

forming spheroid steel balls from a metal with a carbon content between 0.8 and 4.0% C by weight, the metal being steel or iron-based metal;

subjecting said balls to a heat treatment for softening the metal by graphitisation while remaining in the ferritic range; and wherein the method is performed under a non-reducing atmosphere; and wherein the carbon content of the steel or iron-based projectile is substantially similar to that of the metal.

2. Method as in claim 1, wherein the softening heat treatment comprises at least the following successive steps:

annealing said metal for about 3 minutes from room temperature up to a temperature higher than 800° C.;

cooling said steel in water, at a speed of at least 20° C./s down to room temperature;

tempering said metal under non-oxidising or slightly reducing atmosphere of HNx type to a temperature below 700° C.;

maintaining said metal under the above-mentioned atmosphere at this last temperature for a period of between 1 and 6 days.

3. The method as in claim 2, wherein the metal is cooled in boiling water.

4. The method as in claim 2, wherein the metal is tempered under non-oxidising or slightly reducing atmosphere of HNx type to a temperature below 650° C.

5. The method as in claim 2, wherein the metal is maintained under the non-oxidising or slightly reducing atmosphere of HNx type for a period of between 1 and 4 days.

6. Method as in claim 1, wherein said forming spheroid balls comprises a sintering step using iron powder.

7. Method as in claim 1, wherein said forming spheroid balls comprises a step of mechanical manufacturing using wire or sheet.

8. The method of claim 1, wherein said forming spheroid steel balls includes casting with liquid steel or pig iron, hereafter called molten metal with a carbon content between 0.8 and 4.0% C by weight; the molten metal is cast according to a water or steam granulation method in order to obtain the spheroid steel balls.

9. Method as in claim 8, wherein the metal also comprises, expressed in weight, maximum 0.4% Mn, between 0.1 and maximum 2.0% Si, maximum 2.0% Al, maximum 0.04% P, maximum 0.04% S and maximum 1% of other alloy elements, the balance being iron and common impurities.

10. Method as in claim 8, wherein the water or steam granulation step is carried out in the presence of a surfactant.

11. Method as in claim 8, wherein the water or steam granulation step is preceded by the step of dividing the flow of molten metal.

12. Method as in claim 11, wherein the step of dividing the flow of molten metal is carried out by means of a rotating plate.

13. Method as in claim 12, wherein the rotating plate is a plate made of a material that is not wetted by the molten steel, such as for example zirconia, alumina, boron nitride or syalon.

14. Method as in claim 12, wherein the rotating plate is a perforated plate.

15. The method of claim 8, wherein the carbon content is between 0.8 and 2.0% C by weight.

16. The method of claim 1, wherein the hardness is between 40 HV 10 and 85 HV 10.

17. The method of claim 1, further comprising subjecting the balls to a surface coating treatment.

18. Spheroid projectile or ball made of steel with a carbon content between 0.8 and 2.0% C by weight and hardness at the core lower than 100 HV 10, preferably lower than 85 HV 10, implemented by means of the method as in claim 1.

19. Projectile as in claim 18, with a carbon content between 1.2 and 1.8% C by weight.

20. Projectile as in claim 18 with a surface coating to prevent aggregation of the charging.

21. Cartridge for hunting or target shooting comprising a charge of steel balls as in claim 18.

* * * * *